United States Patent [19]

Breslow et al.

[11] 3,973,774

[45] Aug. 10, 1976

[54] PROJECTING CATAPULTS AND VIEW OBSTRUCTING CYLINDER

[75] Inventors: Jeffrey D. Breslow, Highland Park; Eugene Jaworski, Park Ridge, both of Ill.

[73] Assignee: Marvin Glass & Associates, Chicago, Ill.

[22] Filed: Oct. 2, 1975

[21] Appl. No.: 618,947

[52] U.S. Cl. ..... 273/95 R; 124/33

[51] Int. Cl.[2] ..... A63B 71/02

[58] Field of Search ..... 273/1 R, 95 R, 95 C, 273/101; 124/33, 4

[56] References Cited

UNITED STATES PATENTS

| | | | |
|---|---|---|---|
| 460,717 | 10/1891 | Fisk | 273/101 |
| 689,883 | 12/1901 | Jacobs | 273/101 |
| 1,032,501 | 7/1912 | Pierman | 273/101 |
| 2,129,489 | 9/1938 | Brown | 273/95 C |
| 2,657,057 | 10/1953 | Chapin | 273/101 |
| 3,391,934 | 7/1968 | Ryan | 124/33 |
| 3,582,075 | 6/1971 | Glass | 273/1 R |
| 3,711,097 | 1/1973 | Begley | 273/95 C |

*Primary Examiner*—Richard C. Pinkham
*Assistant Examiner*—Marvin Siskind
*Attorney, Agent, or Firm*—Coffee & Sweeney

[57] ABSTRACT

A game apparatus for a number of players. A plurality of pivoting paddles or catapult levers are radially disposed about a mounting base which has a centrally located upright cylinder or chimney. A catapult portion of each paddle extends into one of a plurality of compartments in the lower portion of the chimney. One or more balls are disposed within the chimney and rest upon one of the catapult portions. The location of the balls within the chimney is unknown to the players. The players singularly attempt to blindly hit the ball out of the chimney and catch it. A competitive point reward system is used if a player successfully locates and hits a ball upwardly from the chimney and successfully catches it.

8 Claims, 4 Drawing Figures

10
14
27
20
18
44
2
2
36
34
24
26
18

18
22
22
24
12
36
29
47
36
3
14
28
16
16
36
20
48
18
3
20
22
36
34
24
18

27
10
14
16
47
48
44
18
22
20
38
18
28
30
36
29
32
46
24
29
22
36
34

18
22
20
16
22
12

PROJECTING CATAPULTS AND VIEW OBSTRUCTING CYLINDER

BACKGROUND OF THE INVENTION

This invention relates to a game device and in particular to competitive action games wherein the location of a game piece is unknown during the game. The players strike pivoting paddles in the form of catapult levers and when one comes into contact with the game piece, that player must catch the game piece before it touches the floor.

It is known to use catapult levers to drive game pieces upwardly and such game devices capture the fascination of the participants of the game. Moreover, those games which involve the element of dexterity and reaction on the part of the participants such as in attempting to catch a particular game piece also strongly captivate the interest of the participants. Such a game is shown in U.S. Pat. No. 3,582,075, assigned to the assignee of the present invention. Other catapult games are shown in U.S. Pat. Nos. 3,391,934 and 3,002,755. There is a continuing need and desire in the game art to provide games of such a character that will captivate the interest of the participants for an extended period of time. It is to the satisfaction of this need and desire that the present invention is directed.

SUMMARY OF THE INVENTION

The game apparatus of this invention includes a plurality of pivotal paddles in the form of catapult levers and a centrally located upright cylindrical chimney mounted upon a supporting base. A catapult portion of each of the pivotal paddles extends into individual compartments in the lower portion of the chimney. One or more balls are randomly deposited within the chimney for striking by a player manually hitting the outer end of the paddle. The position of the balls within the chimney is unknown to the players and a reward point system is used if a player successfully locates and hits a ball upwardly from the chimney and successfully catches it. The game captures the fascination and attention of the players because of the mystery of ball location and the dexterity required to catch the ball if a player does find it.

Other objects, features and advantages of the invention will be apparent from the following detailed description taken in connection with the accompanying drawings.

DESCRIPTION OF THE PREFERRED EMBODIMENT

The game apparatus of this invention, generally designated 10, includes a plurality of pivotal paddles in the form of catapult levers 12 radially disposed about an upstanding chimney 14.

Figure 2:
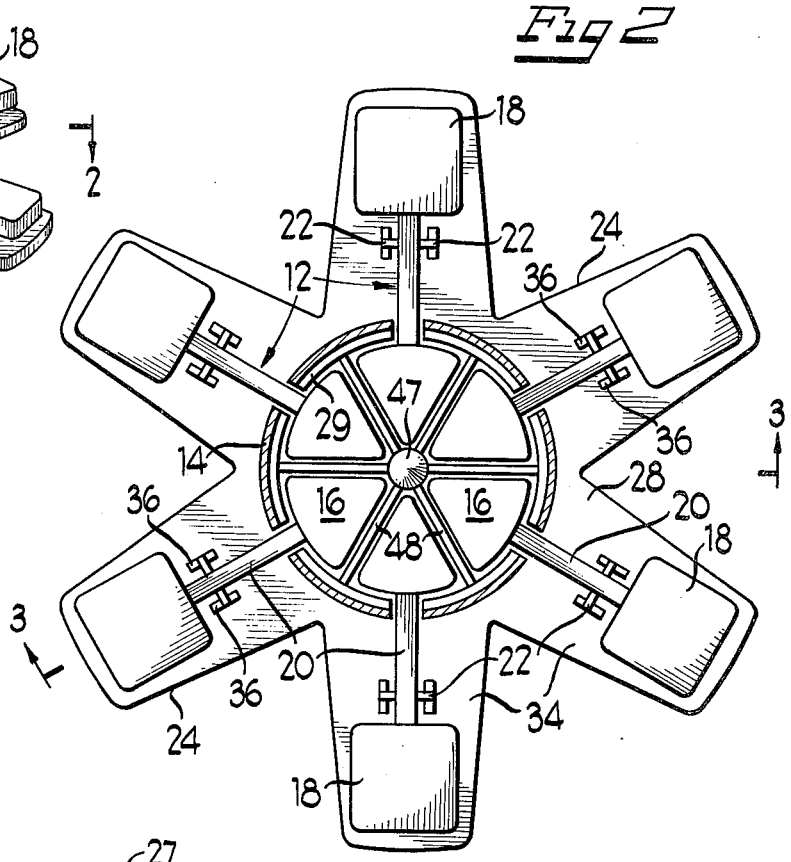
FIG. 2 is a horizontal sectional view, on an enlarged scale, taken approximately along line 2—2 of FIG. 1.
Figure 3:
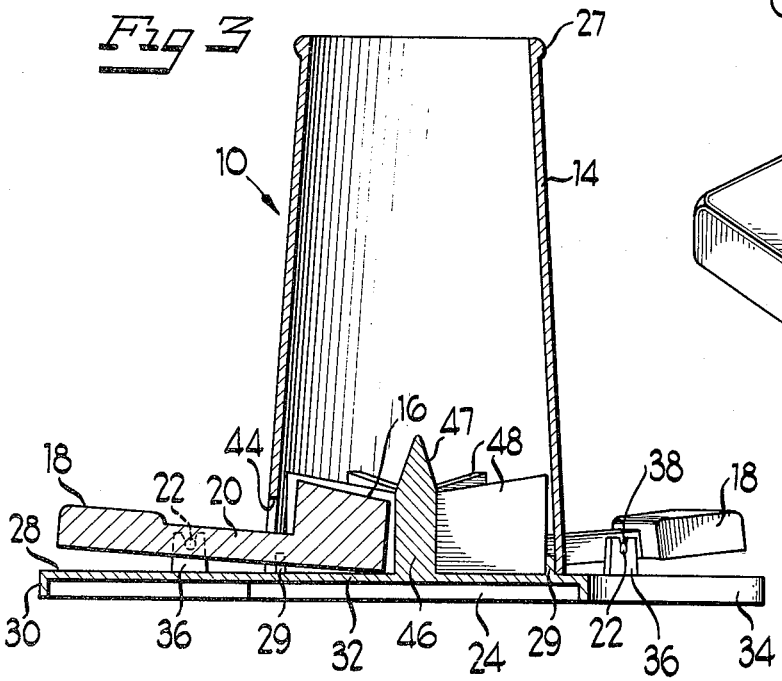
FIG. 3 is a vertical sectional view taken approximately along line 3—3 of FIG. 2.
Figure 4:
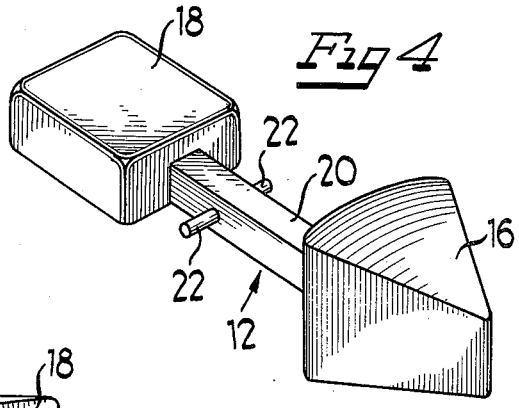
FIG. 4 is a perspective view, on an enlarged scale, of a paddle or catapult lever.

As can be seen more clearly in FIG. 4, a paddle assembly comprises a ball striking or catapult portion 16, and an impact receiving portion 18. A pair of transverse pivot pins 22 are positioned in the arms 20. As shown in FIGS. 2 and 3, the ball striking portion 16 is disposed within the chimney 14 and is adapted when activated to propel a ball 26 upwardly.

Figure 1:
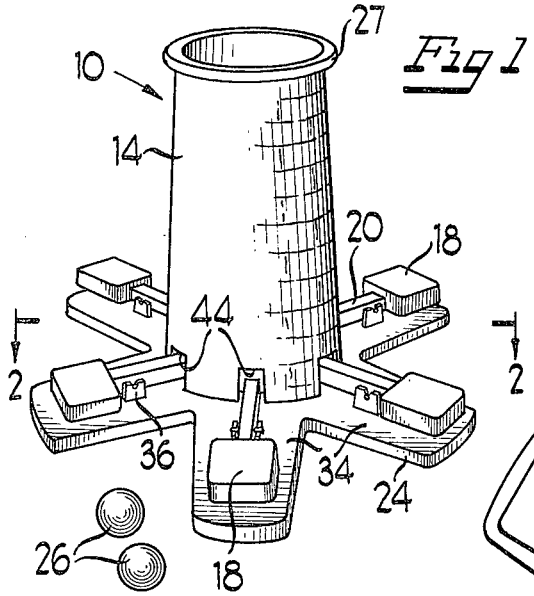
FIG. 1 is a perspective view of the game of the present invention including two playing balls.

Referring to FIG. 1, the chimney 14 is a hollow truncated cone. A strengthening rim 27 is disposed at the upper edge of the chimney 14 and extends outwardly therefrom.

The chimney 14 is supported by a mounting frame 24. Referring to FIG. 3, the mounting frame 24 comprises a generally flat support base 28 having a depending rib 30. The support base 28 has a central portion 32 which supports the chimney, and fingers or spokes 34 extend radially outwardly from the central portion 32. A rib 29 forms a circular upstanding rim extending from the hub portion 32 of the support member 28. The lower portion of the chimney 14 is force fit around the rim 29. The fingers 34 support and mount the paddle assemblies 12 and are generally rectangular in shape and include a pair of separated stand-off supports 36. The stand-off supports 36 are of a generally rectangular shape and are separated from each other by a distance sufficiently to clear the arm 20. An elongated recess 38 extends downwardly from the uppermost edge of each of the stand-off supports 36. The recesses 38 receive the pivoting pins 22 mounted on the arm 20 by a snap fit. The pins are located off-center on the arm 20 so that the ball striking portion 16 rests in the down position.

The arms 20 extend through generally rectangular apertures 44 in the lowest portion of the chimney 14 such that the ball striking member 16 rests inside upon the central portion 32. As can clearly be seen in FIG. 2, the ball striking members 16 are pie-shaped so that they nest neatly within the chimney 14.

An upstanding generally cylindrical solid post 46 extends upwardly from the hub portion 32, concentric with the chimney 14. The post 46 terminates in an inverted conical shape 47. The inner apex of the ball hitting members 16 lie in close proximity to the post 46. A plurality of partitions 48 radiate outwardly from the post 46 between the ball hitting members 16 to define compartments for positioning a ball on top of one of the ball hitting members.

The game may be played by anywhere from two to six players. Anyone of the players tosses one or more balls 26 (two are shown herein) into the top of the chimney, permitting the balls to come to rest on top of one of the ball hitting members 16 within one of the compartments defined by the partitions 48. The positions of the balls within the chimney is unknown to the players, thereby introducing an element of chance to the game. One of the players hits an impact receiving member 18 with the hope that one of the pair of balls 26 is resting upon his ball striking portion 16. If one of the pair of balls 26 is so situated, the ball will be propelled upwardly through the top of the chimney 14. If the player is able to catch the ball 26 before it bounces, that player receives a point. He then throws the ejected ball 26 back into the top of the chimney 14. As long as a player successfully hits a ball and catches it, his turn continues. If one of the players hits an impact receiving member 18 and there is no ball situated upon the ball striking member 16, the next player then tries. Of course, many other schemes of play are available with the game device of the present invention. For instance, anyone player may be given a chance to guess which of these catapult levers to strike.

The foregoing detailed description has been given for clearness of understanding only and no necessary limitations should be understood therefrom as some modifications will be obvious to those skilled in the art.

We claim:

1. A game device comprising:

a base;

an upright open-top tubular member mounted on said base;

a plurality of catapult levers pivotally mounted on said base, each catapult lever including an impact receiving portion and a playing piece striking portion, the playing piece striking portion of each catapult lever being located within said tubular member and the impact receiving portion of each catapult assembly being located outside the tubular member for striking by a player of the game; and a playing piece freely located within said tubular member in an unknown position to the players whereby a player seeks to strike the impact receiving portion of the proper catapult lever so that the playing piece striking portion thereof will propel the ball out of said tubular member.

2. The device of claim 1 including partition means in the bottom of said tubular member dividing the same into compartments one for each catapult lever.

3. The device of claim 1 wherein said catapult levers have off-center pivots so that the playing piece striking portions thereof rest in a down position.

4. The device of claim 1 wherein said playing piece is a ball.

5. The device of claim 4 including partition means in the bottom of said tubular member dividing the same into compartments one for each catapult lever.

6. A game device comprising:

a base;

an upright chimney mounted on said base;

a plurality of catapult levers pivotally mounted on said base, each catapult lever including an impact receiving portion outside of the chimney and a ball striking portion disposed within the bottom of the chimney, the ball striking portion of each catapult lever being pie-shaped so as to nest within said chimney; and a ball freely located within said chimney in an unknown position to a player whereby the player seeks to strike the impact receiving portion of the proper catapult lever so that the ball striking portion will propel the ball out of said chimney.

7. The device of claim 6 including partition means in the bottom of said tubular member dividing the same into compartments one for each catapult lever.

8. The device of claim 6 wherein said catapult levers have off-center pivots so that the playing piece striking portions thereof rest in a down position.

* * * * *